United States Patent [19]

Grotepass

[11] 4,375,884

[45] Mar. 8, 1983

[54] APPARATUS FOR THE CONTROLLED COOLING OF WIRE ROD FROM ITS ROLLING TEMPERATURE

[75] Inventor: Johann Grotepass, Hösel, Fed. Rep. of Germany

[73] Assignee: SMS Schloemann-Siemag Aktiengesellschaft, Dusseldorf, Fed. Rep. of Germany

[21] Appl. No.: 347,316

[22] Filed: Feb. 9, 1982

[30] Foreign Application Priority Data

Feb. 14, 1981 [DE] Fed. Rep. of Germany ..... 3105492

[51] Int. Cl.[3] ..... C21D 9/52

[52] U.S. Cl. ..... 266/115; 266/106; 266/259; 148/153; 148/156

[58] Field of Search ..... 266/111, 112, 113, 114, 266/115, 106, 102, 249, 142, 259, 260, 44; 148/153, 155, 157, 156

[56] References Cited

U.S. PATENT DOCUMENTS

| | | | |
|---|---|---|---|
| 3,735,966 | 5/1973 | Hoffmann | 266/102 |
| 3,940,961 | 3/1976 | Gilvar | 72/40 |
| 3,940,967 | 3/1976 | Vitelli | 72/201 |
| 4,054,276 | 10/1977 | Wilson | 266/106 |

FOREIGN PATENT DOCUMENTS

| | | | |
|---|---|---|---|
| 2536236 | 2/1977 | Fed. Rep. of Germany | 148/155 |

*Primary Examiner*—L. Dewayne Rutledge
*Assistant Examiner*—Christopher W. Brody
*Attorney, Agent, or Firm*—Holman & Stern

[57] ABSTRACT

Apparatus for cooling rolled wire rod consists of a first part which guides the wire rectilinearly and cools it with water, a turn-laying unit which forms the wire into turns and lays the turns in staggerred disposition on a continuously running conveyor, and a second part comprising the conveyor which allows passage of an approximately vertically directed stream of air to the turns and conveys the wire turns to a coil forming station which collects them. In order to provide substantial adaptability to various cooling requirements by means of simple and inexpensive conversion, the two parts are composed of a plurality of modules of the same modular length or an integral multiple of the modular length. A base frame carries the modules and the turn-laying unit is fixed on the base frame in a longitudinally displaceable manner. Thus, the lengths of the first and second parts can be changed, and individual modules or groups can be replaced.

12 Claims, 12 Drawing Figures

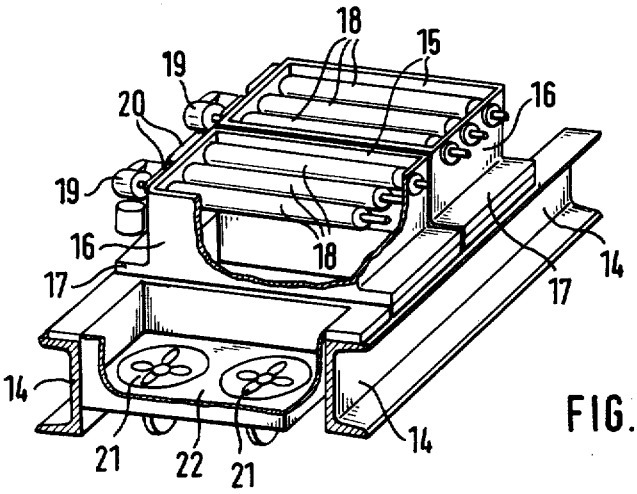
FIG. 2
FIG. 5
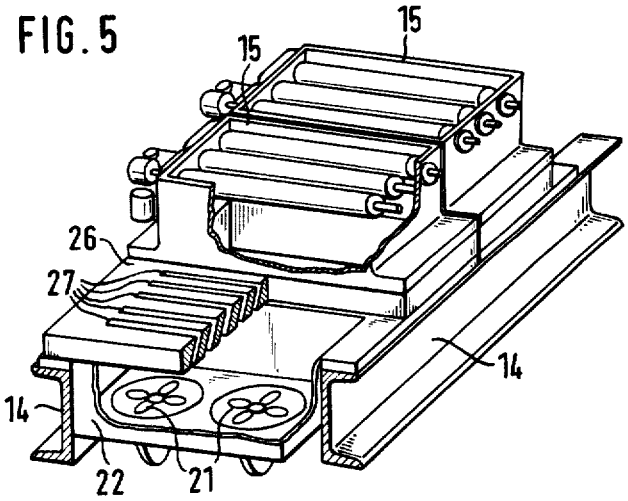

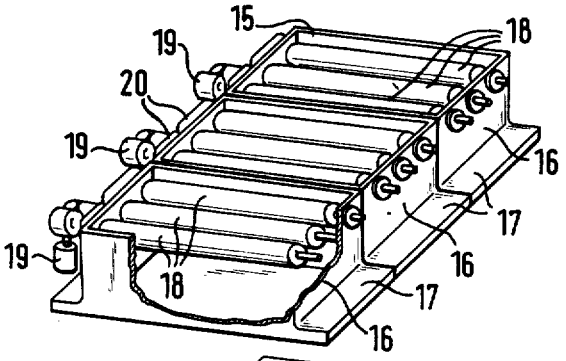
FIG. 3
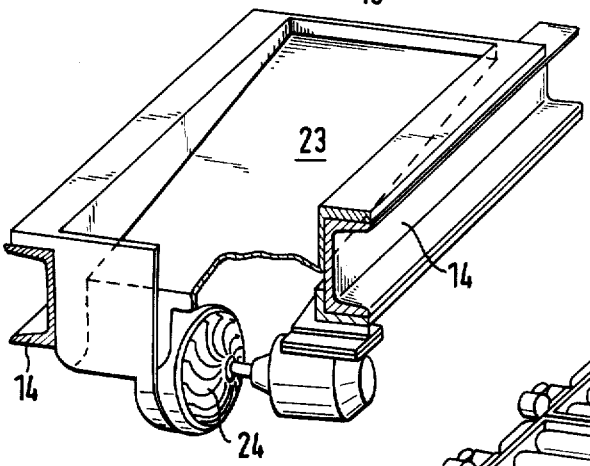
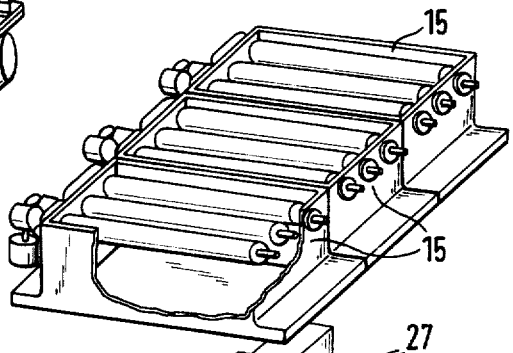
FIG. 6
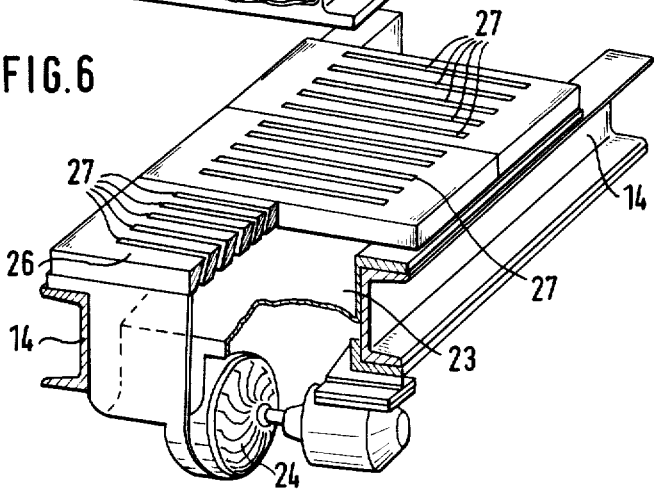

APPARATUS FOR THE CONTROLLED COOLING OF WIRE ROD FROM ITS ROLLING TEMPERATURE

The controlled cooling of (steel) wire rod from its rolling temperature has attained considerable importance during the last two decades with the introduction of the so-called Stelmor Process. In this process, the wire leaving the rolling mill is directly fed on to a cooling device consisting of a first part which guides the wire rectilinearly and cools it with water in portions, a turn-laying unit which forms the wire into turns and lays the turns in staggered disposition on a continuously running conveyor, and a second part in the form of a conveyor which allows passage to an approximately vertically directed stream of cooling medium and its access to all turn portions, the conveyor of the second part of the cooling device conveying the wire turns to a coil forming station which collects them and forms them into coils. The structure and the cooling intensity in the two parts of the cooling device are determined by the type of steel and the diameter of the wire to be cooled, and its throughput.

Although originally used for patenting wire made of steel having a middle to high carbon content, the process quickly became generally usable by adaptation to the cooling requirements of other types of steel, in order to dispense with the otherwise necessary heat treatment of the wire before its further processing. The cooling requirements of the very varied types of steel made modifications to the cooling device necessary in order to be able to adjust the cooling intensity and the cooling pattern within wide limits. Examples of this are represented by German patent specifications Nos. 1 752 519, 2 009 839, 2 150 609, and 2 546 589. In spite of considerable additional constructional expenditure, the range of application of the devices is still limited, and adaptation to subsequently occurring applications which were either not initially planned or were deferred for cost reasons are either not possible or only possible at high cost.

German Pat. No. 1 508 443 discloses means for increasing the adaptability of the cooling device to strongly differing cooling requirements. According to this proposal, the turn-laying unit is displaceable along the device, and by this means the actual lengths of the first and second part of the cooling device are variable, whereas the basic construction of the device in both its parts otherwise corresponds to the state of the art and, as in the case of this latter, can be modified either not at all or only at high cost.

This proposal has as yet practically no importance.

The object of this invention is to provide simple and cost-saving conversion facilities in order to attain substantial adaptability of the cooling device to very different cooling requirements.

According to the invention, the two parts of the cooling device are composed of a plurality of modules all of the same basic length or an integral multiple of the basic length, and mounted on a base frame, on which the turn-laying unit is also fixed in a longitudinally displaceable manner, the modules or groups of modules differing in their guide or conveying function and/or influecing the cooling action in different ways.

The modules of the first part of the cooling device may be provided with pipe pieces which guide the wire rectilinearly, and the pipe pieces can be provided with a cooling water feed, and be combined with a collection tank for the discharged cooling water.

The modules of the second part of the cooling device may be in the form of basic units of a conveyor for conveying wire turns lying in staggered disposition thereon in the conveying direction, and of which the conveying means provide passage for an approximately vertically directed stream of cooling air and access therefor to all wire turn portions.

The hot wire turns lying on the conveyor generate a thermal convection upcurrent, which is sufficient if only moderate cooling rates are required. Very high cooling rates can be attained if a frame comprising vertically operating fan impellers is disposed below each conveyor module. In most cases it is sufficient if one air chamber fed by a blower is disposed below several conveyor modules, this making a high cooling rate attainable.

A known method for influencing the cooling rate, and which is used in practice, is to lay the wire turns on the conveyor with a greater or lesser degree of stagger by correspondingly adjusting the conveyor speed. If the cooling requirements require a period of rapid cooling followed by a period of slow cooling, for which purpose the wire turns need to be laid more densely, or if the wire turns need to be spread apart in order to allow trouble-free discharge into the coil forming station, this can be particularly easily attained in the case of the cooling device according to the invention, in that modules which are disposed in or belong to one section of the conveyor are disposed higher than subsequent modules of another section of the conveyor driven at a different conveying speed, this being attained in most simple manner by shims between the modules and the base frame.

If the cooling rate is required to be further reduced, this can be attained by limiting the flow of cooling air and, further, by preventing heat radiation To achieve this plates of a constructional material which restricts the heat radiation and which are provided with slots for the passage of a stream of cooling air are disposed below the individual modules or groups of modules of the second part of the cooling device, between the modules and the shims, the frames for the fan impellers, or the air chambers, depending upon the actual case, this having the required action of preventing heat radiation downwards and stopping undesirable air movement, whereas the slots allow sufficient passage of a cooling air stream produced by the fan or blower so that the plates can remain under the modules, except for the case of cooling by means of an upcurrent due to hot air.

If a very slow cooling of the wire rod is necessary, this can be attained, if the conveyor modules are fitted, on the inner walls aligned with the longitudinal sides of the conveyor, with plates constructed of material which restricts heat radiation, and if U-shaped hoods constructed of material which restricts heat radiation are mounted on the modules in order to form portions of a heat-retaining tunnel.

The invention is described in greater detail with reference to the drawings, in which:

FIG. 1 is a perspective overall representation of one embodiment of the invention of which, FIGS. 2 and 3 show details to an enlarged scale;

FIGS. 4 to 8 show further details which represent modifications;

Figure 1:
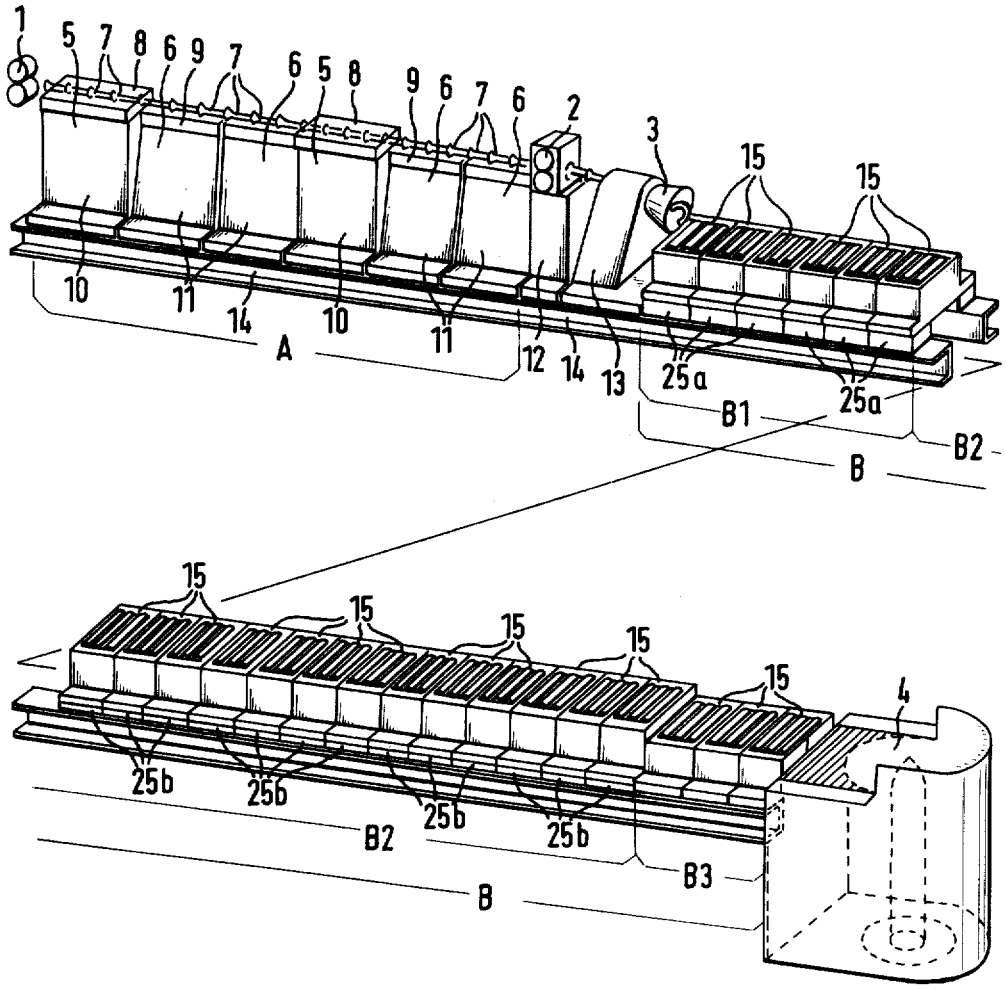

FIG. 9 again shows the embodiment illustrated in FIG. 1; and

Figures 9, 10, 11, 12:
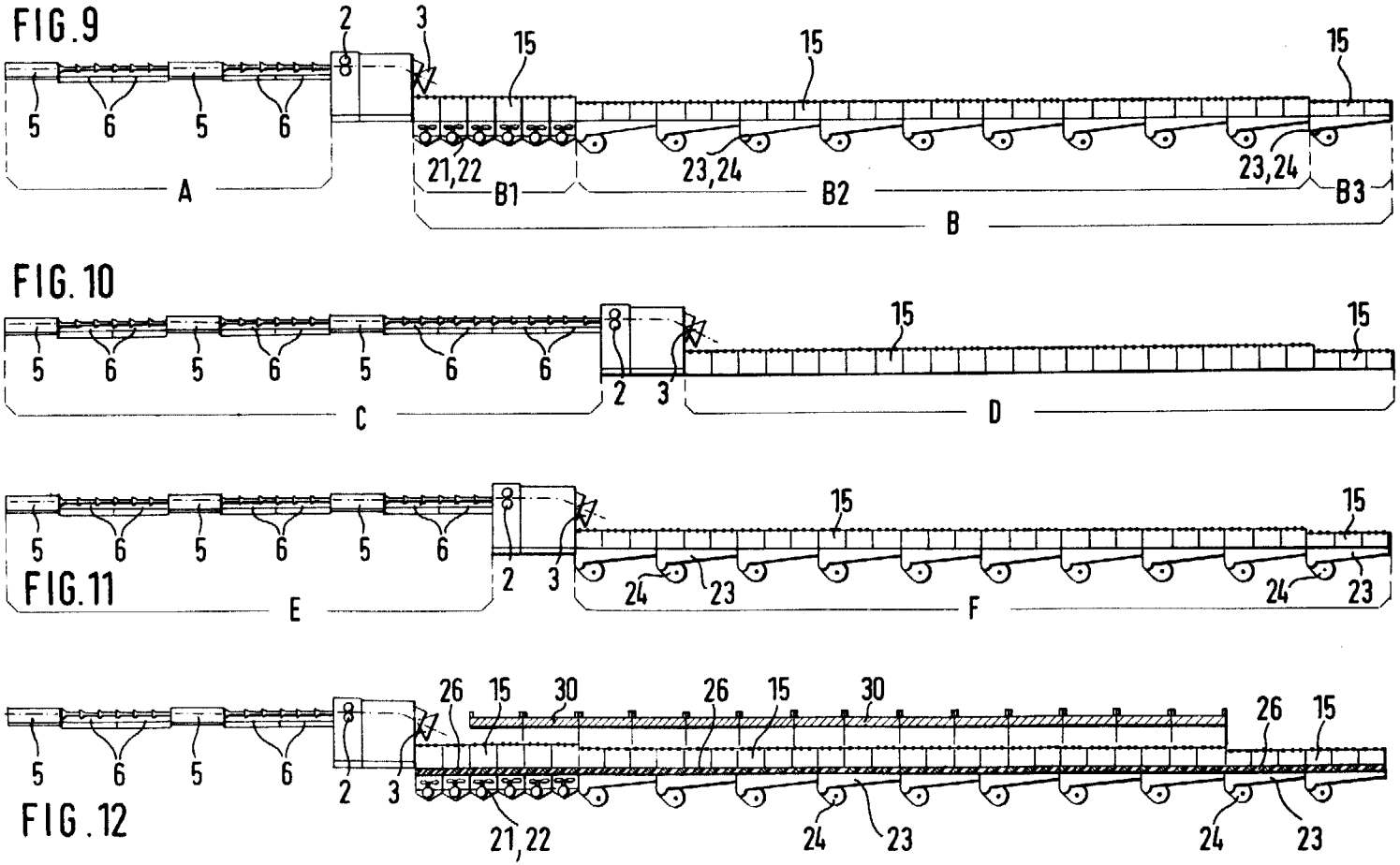

FIGS. 10, 11 and 12 shown diagrammatic examples of modifications of the embodiment shown in FIG. 9.

In the overall view of FIG. 1, the reference numeral 1 indicates the last pair of rolls of a wire rod mill. The finished rolled wire leaving the pair of rolls 1 directly enters the cooling device, which consists of a first part A and a second part B, which itself is divided into sections B1, B2 and B3. A driving roll stand 2 and a turn-laying unit 3 are disposed between the two parts A and B. A coil forming station 4 follows the part B, or rather the last section B3 of the cooling device.

The first part A of the cooling device which guides the wire rectilinearly is composed of modules 5 and 6. The modules 5 and 6 are provided with wire-guiding pipe pieces 7 which in the modules 5 are combined with a collection tank 8 and in the modules 6 are combined with a supporting member 9, the pipe pieces 7 of the modules 5 being provided also with cooling water feeds, such as those of German Pat. No. 27 14 019 (not shown). The collection tanks 8 of the modules 5 are supported by pedestals 10, and the supporting members 9 of the modules 6 are supported by pedestals 11, which pedestals in their turn are releasably fixed on an elongate base frame 14 of the cooling device. The modules 5 and 6 have a length equal to twice a predetermined modular length.

A pedestal 12 having a length equal to the modular length, supporting the driving roll stand 2, and the bearing housing 13 of the turn-laying unit 3, of twice the modular length, follow the pedestals 10 and 11 on the base frame 14, and are likewise releasably fixed thereto. The turn-laying unit 3 forms the wire into turns of helical shape, and lays these on to the following conveyor in the second part of the cooling device. The turns become laid on to the conveyor with a greater or lesser degree of stagger, according to the conveying speed of the continuously driven conveyor.

The conveyor, i.e. the second part B of the cooling device, is composed of modules 15 which form basic conveyor units having equal lengths equal to the modular length. The modules 15 consist of a frame 16 with fixing flanges 17. The frame 16 is open upwards and downwards. Conveying rollers 18 are journalled in the longitudinal side walls of the frame 16. The shafts of the conveying rollers 18 pass through one of the longitudinal sides of the frame 16. One shaft of each module 15 is driven by a geared motor 19. Sprocket wheels mounted on the shaft journals and chains 20 are used for connecting together and driving all conveying rollers 18 of a module 15. The conveying speed of any given module is continuously adjustable.

In the embodiment of FIG. 1, the second part B of the cooling device is divided into sections B1, B2 and B3, in order to be able to satisfy the necessary cooling requirements, which in the section B1 demand very rapid cooling. For this purpose, on the one hand the modules 15 of this section are set to a very high conveying speed so that the turns become staggered at a large spacing (more than 35 mm), i.e. are spread widely apart, and on the other hand the modules 15 are combined with fans 21 for producing a very strong air stream (see FIG. 2). The fans 21 are supported in frames 22, which have the same connection dimensions as the modules 15, and are disposed under these latter and together with the modules 15 are fixed on to the base frames 14.

In the case of widely staggered turns, the modules 15 together with the fans 21 in the frames 22 provide for a cooling intensity which is suitable for continuing at a sufficiently strong rate the initial cooling which has commenced strongly in the first part A of the cooling device. This has the advantage that the first part A of the cooling device can be kept correspondingly short, and the turns can be then laid down at about 850° C. A short distance between the last roll stand and the turn-laying unit with a correspondingly high temperature of the wire in the turn-laying unit are important conditions for a high terminal rolling speed of 75 m/sec or more. However, in those cases in which a particularly low temperature (800° C. or less) must already be attained at the turn-laying unit, the embodiment of the cooling device according to the invention enables the first part A of the cooling device to be lengthened by a number of modules, and the second part B to be shortened by a corresponding number of modules, with a corresponding displacement of the driving roll stand 2 and the turn-laying unit 3, by which means the rolling mill can be driven with a lower terminal rolling speed.

The very rapid cooling in the section B1 needs only to be followed by rapid cooling, which is ensured in the section B2 by the fact that an air chamber 23, fed by means of a blower 24 (see FIG. 3), is disposed under several, for example three, modules 15. The modules 15 lie on the air chambers 23 and are disposed together with these latter on the base frame 14. The air blown into the chambers 23 emerges at the modules 15 between the rollers 18. The cooling rate aimed for in the section B2 is attained with a medium staggering of the turns (about 20 to 30 mm), and the modules 15 in the section B2 are therefore set to a medium conveying speed. In order for the wire turns to be able to be drawn together easily and without trouble during their transfer from the section B1 to the section B2, the modules 15 in the section B2 are disposed somewhat lower than in the section B1, this being attained by means of shims of different thickness, namely shims 25*a* for the modules 15 in the section B1 and shims 25*b*, of lesser thickness, for the modules 15 in the section B2. The modules 15 in the section B3 also lie on an air chamber 23, and are mounted together therewith on the base frame 14. The conveying speed of the modules 15 in the section B3 is however set to that necessary for transferring the turns into the coil forming station 4, this being somewhat higher than the conveying speed in the section B2. In order to enable the wire turns to spread out from each other on transfer from the section B2 into the section B3 without difficulty, the modules 15 in the section B3 are set lower than in the section B2 by mounting the modules 15 in the section B3 without shims.

Figure 4:
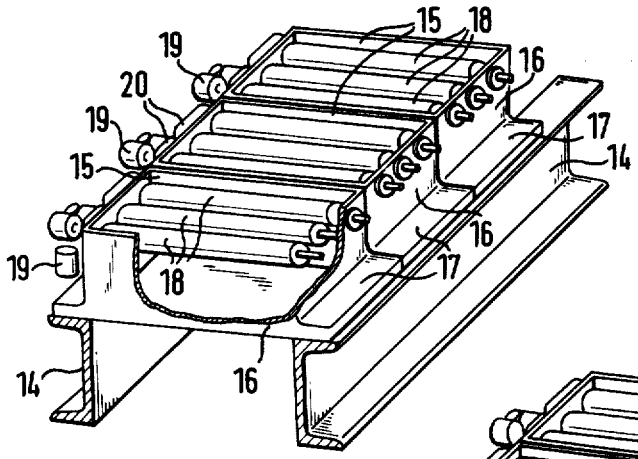

In those cases in which only a moderate cooling rate in the second part B of the cooling device or in one of its sections is required, or if the wire turns are to be merely conveyed, the modules 15 are mounted directly on the base frames 14 (see FIG. 4). The sensible heat of the wire turns conveyed on the modules 15 gives rise to an air movement (upcurrent due to hot air), which results in a moderate cooling rate.

Figure 7:
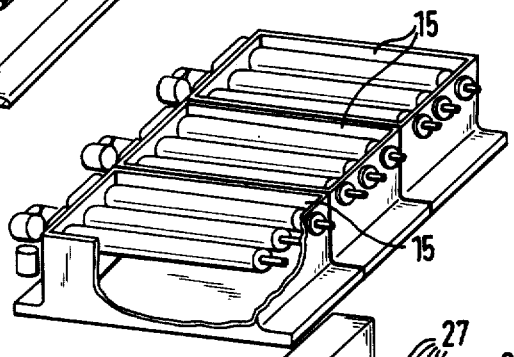

The moderate cooling rate produced by the natural air movement (upcurrent due to hot air) and by heat radiation is still too high for the cooling requirements of one group of steels. In such cases, the modules 15 can be closed in a downward direction by plates 26 disposed thereunder (see FIGS. 5, 6 and 7). In order not to have to remove the plates 26 each time the cooling programme is changed to accelerated cooling, the plates 26 are provided with slots 27 which desirably slope upwards in the conveying direction. The ribs which remain between the slots 27 provide such a braking action on the air stream that natural air movement is strongly reduced. The downward heat radiation is substantially restricted by the plates 26, even if these are provided with slots 27. The retarded air movement and the partially downwardly restricted heat radiation provide only slow cooling. The plates 26 consist of heat-resistant material which restricts heat radiation. However, the slots 27 in the plates 26 enable an air flow produced by a fan or blower to be fully active when the plates 26 are disposed between the frame 22 of the fan 21 and the modules 15 (see FIG. 5) or between the air chambers 23 and the modules 15 (see FIG. 6), with the slots 27 immediately guiding the air stream in the required direction by virtue of their inclination.

Figure 8:
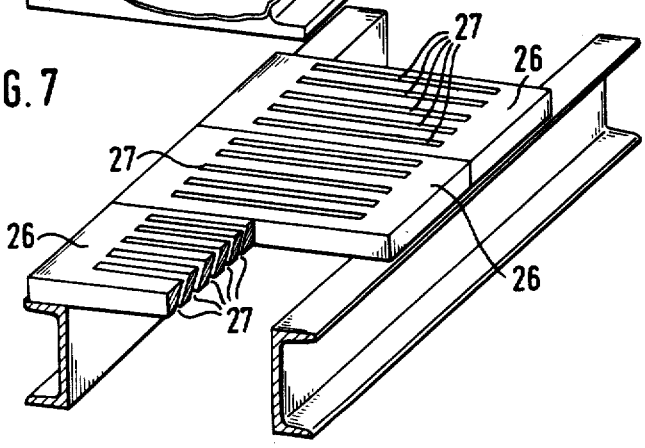
Figure 8:
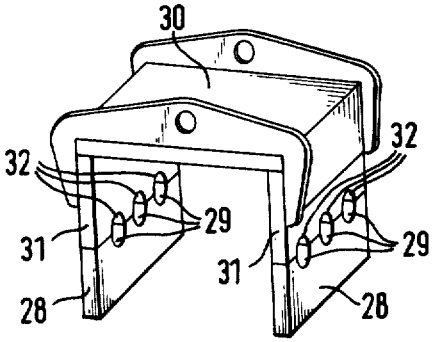

In order to attain very slow cooling, the heat radiation can be further restricted. For this purpose, the modules 15 are fitted along the inner walls of their longitudinal sides with plates 28 which are joined to the inner walls and are provided on their upper surfaces at the level of the axes of the conveying rollers 18 with semi-circular recesses 29 having a somewhat larger radius than the radius of the conveying rollers 18. Hoods 30 are lowered from above on to the modules 15 so that their side walls 31 become supported on the plates 28 and are likewise provided with semi-circular recesses 32 (see FIG. 8). Although the plates 28 can remain in the modules 15, the hoods 30 are only mounted on the modules 15 when required.

The embodiment shown in FIG. 1, in which a proportion of the modules 15 in the section B2 have been omitted, is again shown in FIG. 9, this time complete but in diagrammatic form, but with the roll stand before the cooling device and the base frame and subsequent coil forming station being omitted.

Some examples of possible modifications of the embodiment shown in FIG. 1 as allowed by the invention are illustrated in FIGS. 10, 11 and 12.

Thus, FIG. 10 shows a cooling device which is of very simple construction and can be used for various types of bulk steels which if subjected to strong initial cooling in the first part C require only moderately rapid cooling in the second part D. The length of the first part C lying before the turn-laying unit 3 together with the stronger cooling of the wire in this part and thus the relatively low temperature of the wire in the turn-laying unit 3 allow only a limited passage speed for the wire, if trouble-free operation is to be ensured. A cooling device structure as shown in FIG. 10 can however be quite suitable as a first constructional stage, due to the fact that the embodiment according to the invention readily allows modifications to be made to the cooling device.

If high rolling speeds are to be used and if the materials to be cooled require strong cooling in the second section of the cooling device, a cooling device structure as shown in FIG. 11 is recommended. In this case, the first part E of the cooling device is shorter than the structure of FIG. 10, whereas the second part F is correspondingly lengthened and is equipped for strong cooling by the fact that air chambers 23 with blowers 24 are disposed under the modules 15, as shown in FIG. 3.

Very high rolling speeds require a further shortening of the first section of the cooling device, and the structure shown in FIG. 9 is recommended, which allows very strong cooling in the section B1, as already described. As the very strong cooling in the section B1 is effective in the case of wire of small cross-section, it is recommended to convert the cooling device into the structure shown in FIG. 11 when rolling wire of large cross-section which has to be rolled with low terminal speed.

As the example of FIG. 12 shows, a cooling device according to the invention—that of FIG. 9 in the example—can easily be equipped for very slow cooling by disposing plates 26 under the modules 15 and inserting plates 28 into the modules 15. It is then necessary only to mount the hoods 30 and stop the fans 21 and blowers 24. In addition, the modules 15 of sections B1 and B2 are adjusted to low conveying speed so that the wire turns become densely packed with only a small stagger (up to 3 mm). After removing the hoods 30, starting the fans 21 and blowers 24 and setting the higher conveying speeds for the modules 15 in sections B1 and B2, the cooling device of FIG. 12 operates in the same manner as that of FIG. 9.

I claim:

1. Apparatus for the controlled cooling of wire rod from its rolling temperature, comprising:

(a) an elongate base;

(b) a first cooling assembly mounted on the base and composed of a plurality of modules each having a length equal to a predetermined modular length multiplied by an integar, said first cooling assembly being adapted to guide the wire rod rectilinearly and to cool it with water;

(c) a turn-laying unit mounted on the base following the first cooling assembly for forming the wire rod into turns and laying these turns in a staggered disposition;

(d) and a second cooling assembly mounted on the base following the turn-laying unit for receiving the staggered turns and conveying these continuously and composed of a plurality of modules each having a length equal to the said modular length multiplied by an integer;

(e) the turn-laying unit being disposable on the base selectively at a plurality of different positions along the base, whereby the lengths of the cooling assemblies can be changed by selection of the disposition of the turn-laying unit and of the modules composing said assemblies.

2. Apparatus for the controlled cooling of wire rod from its rolling temperature, consisting of a first part which guides the wire rectilinearly and cools it with waterin portions, a turn-laying unit which forms the wire into turns and lays the turns in staggered disposition, and a second part comprising a continuously running conveyor which receives said turns and allows passage for an approximately vertically directed stream of cooling medium and its access to all turn portions, and which conveys the wire turns to a coil forming station disposed after the conveyor and which collects them and forms them into coils, the turn-laying unit being adjustable along the apparatus for changing the actual lengths of the first and second parts, characterised in that the said two parts are composed of a plurality of modules of the same basic modular length or an integral multiple of the basic modular length, and the apparatus has a base frame which carries the modules and on which the turn-laying unit is also fixed so that it is displaceable in the longitudinal direction, the modules or groups of modules differing in their guide or conveying function and/or influencing the cooling action in different ways.

3. Apparatus as claimed in claim 2 in which the modules of the first part are provided with pipe pieces which guide the wire rectilinearly.

4. Apparatus as claimed in claim 3 in which in at least one module of the first part the pipe pieces are provided with a cooling water feed, and a collection tank is provided for the discharged cooling water.

5. Apparatus as claimed in claim 2 in which the modules of the second part are in the form of basic units of a conveyor for conveying the staggered wire turns layers thereon and of which the conveyor provides passage for an approximately vertically directed stream of cooling air and access therefor to all wire turn portions.

6. Apparatus as claimed in claim 5 in which a frame in which are provided vertically operating fan impellers is disposed below at least one conveyor module.

7. Apparatus as claimed in claim 5 in which an air chamber fed by a blower is disposed below a plurality of the conveyor modules.

8. Apparatus as claimed in claim 5 in which the conveyor is composed of sections driven at different speeds and modules which are disposed in or belong to one section of the conveyor are disposed higher than modules of a subsequent section driven at a different conveying speed.

9. Apparatus as claimed in claim 8 in which the higher disposed modules are supported on the base frame by shims of corresponding thickness.

10. Apparatus as claimed in any one of claims 5 to 9 in which a plate of a constructional material which restricts the heat radiation, and which is provided with slots for the passage of a stream of cooling air, is disposed below at least one module of the said second part.

11. Apparatus as claimed in any one of claims 5 to 9, in which at least one module of the second part is provided with means restricting heat radiation.

12. Apparatus as claimed in any one of claims 5 to 9 in which at least one module of the second part is provided with heat radiation-restricting means comprising plates of material which restricts heat radiation, and U-shaped hoods of material which restricts heat radiation in order to form portions of a heat-retaining tunnel.

* * * * *